US005733213A

United States Patent [19]

Colarusso

[11] Patent Number: 5,733,213

[45] Date of Patent: Mar. 31, 1998

[54] ROLLER HOCKEY PUCK AND METHOD OF MAKING THE SAME

[76] Inventor: Michael Colarusso, 1740 N. Dulcie Cir., Simi Valley, Calif. 93063

[21] Appl. No.: 833,484

[22] Filed: Apr. 7, 1997

[51] Int. Cl.[6] ..... A63B 71/02

[52] U.S. Cl. ..... 473/588

[58] Field of Search ..... 473/588, 589, 473/229

[56] References Cited

U.S. PATENT DOCUMENTS

| | | | |
|---|---|---|---|
| 2,727,744 | 12/1955 | Watson | 473/588 |
| 3,784,204 | 1/1974 | Felber | 473/588 |
| 4,793,769 | 12/1988 | Dolan | 473/588 |
| 4,801,144 | 1/1989 | De Masi, Jr. et al. | 473/588 |
| 5,275,410 | 1/1994 | Bellehumeur et al. | 473/588 |
| 5,346,214 | 9/1994 | Bruhm | 473/588 |
| 5,465,966 | 11/1995 | La Savio | 473/588 |
| 5,482,274 | 1/1996 | Bellehumeur | 473/588 |
| 5,518,238 | 5/1996 | Hu et al. | 473/588 X |
| 5,531,442 | 7/1996 | Gill | 473/588 |
| 5,568,923 | 10/1996 | Kahn et al. | 473/588 |

*Primary Examiner*—Raleigh W. Chiu
*Attorney, Agent, or Firm*—John J. Posta, Jr.

[57] ABSTRACT

A roller hockey puck for use in playing the sport of roller hockey on paved surfaces is disclosed which exhibits a minimized coefficient of friction and is thus capable of more freely rolling on an irregular surface, thereby better simulating the behavior of a conventional ice hockey puck on ice. The preferred embodiment roller hockey puck of the present invention uses a spherical roller which is supported by an array of bearings located in the puck body and which extends slightly above the opposing faces of the puck body to minimize friction as the roller hockey puck glides on a paved surface. Annular arrays of runners made of material having a low coefficient of friction are located on and extend out from each of the opposing faces of the preferred embodiment roller hockey puck of the present invention to stabilize the roller hockey puck as it glides on the paved surface.

30 Claims, 8 Drawing Sheets

ROLLER HOCKEY PUCK AND METHOD OF MAKING THE SAME

BACKGROUND OF THE INVENTION

1. Field of the Invention

The present invention relates generally to pucks for use in roller hockey, and more particularly to an improved roller hockey puck which exhibits a minimized coefficient of friction and is thus capable of more freely rolling on a paved surface, thereby better simulating the behavior of a conventional ice hockey puck on ice.

The sport of roller hockey has exploded in the recent past, and because of this tremendous expansion of the sport, the business of providing equipment for roller hockey has also exhibited dramatic growth. While the transition from conventional ice hockey equipment was quick to occur for skates (from ice skates to in-line roller skates) and hockey sticks (roller hockey sticks having blades made of durable plastic materials rather than wood), the transition from an ice hockey puck to a puck suitable for playing roller hockey has been more difficult. This is due to the tremendous difference between the high coefficient of friction of the paved surfaces on which roller hockey is generally played when compared to the low coefficient of friction exhibited by ice.

As might be expected, the art is replete with potential solutions to this problem, with a wide variety of different design changes having been proposed to provide a puck which glides more smoothly over paved surfaces. The art has focused on four different approaches to providing a roller hockey puck capable of gliding more smoothly over a paved surface. These four approaches are: 1. the use of a material having a lower coefficient of friction to manufacture a roller hockey puck; 2. the use of spherical rollers or balls extending above the opposing faces of the puck; 3. the use of small "runners" which extend above the opposing faces of the puck, the runners being made of material having a low coefficient of friction; and 4. the use of larger area surfaces located on the opposing faces of the puck.

The first approach, namely the use of a material having a lower coefficient of friction to manufacture a roller hockey puck, involves the substitution of plastic materials for the hard rubber used in ice hockey pucks. Since plastic materials have a lower coefficient of friction than does hard rubber, they are more suitable for use in manufacturing roller hockey pucks. Examples of such plastic materials include polyurethane, polyvinyl chloride (PVC), polypropylene, polyethylene, and other hard plastic materials.

While roller hockey pucks made of such plastic materials represent a substantial improvement over the used of hard rubber, the improved roller hockey pucks do not glide nearly as well on paved surfaces as do ice hockey pucks on ice. Some roller hockey pucks have reduced the areas of the opposing faces which may contact the paved surface to further reduce friction. An example of such an approach is U.S. Pat. No. 5,518,237, to Bellehumeur (the Bellehumeur '237 patent), which is made of polyurethane and which uses an annular array of alternately raised and lowered surfaces, with the raised surfaces acting as the "runners" on which the roller hockey puck will glide. However, while this design represents an improvement, it still does not glide on a paved surface nearly as well as an ice hockey puck glides on ice.

The second approach, namely the use of spherical rollers or balls extending above the opposite faces of the puck, is illustrated by U.S. Pat. No. 3,784,204, to Felber, by U.S. Pat. No. 4,793,769, to Dolan, by U.S. Pat. No. 4,801,144, to De Masi, Jr., et al., and by U.S. Pat. No. 5,518,238, to Hu et al.

The Felber reference teaches a molded puck body having a series of chambers molded into each opposing face of the puck body around the outer periphery thereof, each of the chambers opening onto one face of the puck body. Small spherical rollers are retained in the chambers and partially extend out therefrom, with the spherical rollers being able to rotate relatively freely in the chambers to allow the roller puck to glide more easily on an irregular surface.

The Dolan and De Masi, Jr., et al. references teach the use of three larger spherical chambers located within the puck body, each of the spherical chambers being open on both opposing faces of the puck body. Larger spherical rollers located inside the spherical chambers are able to rotate relatively freely therein, and they extend from both opposing puck faces to allow the roller puck to glide more easily on an irregular surface. The Hu et al. reference teaches that the spherical chambers may be open on the cylindrical side edge of the puck body as well as being open on the opposing faces of the puck body. While all of these references in the first group provide an improvement over a flat roller hockey puck made of plastic materials, they still do not glide on a paved surface as well as an ice hockey puck glides on ice.

The third approach, namely the use of small "runners" which extend above the opposite faces of the puck, the runners being made of material having a low coefficient of friction, is illustrated by U.S. Pat. No. 5,275,410, to Bellehumeur et al., by U.S. Pat. No. 5,288,072, to Hsieh, by U.S. Pat. No. 5,346,214, to Bruhm, by U.S. Pat. No. 5,366,219, to Salcer et al., by U.S. Pat. No. 5,482,274, to Bellehumeur (the Bellehumeur '274 patent), and by U.S. Pat. No. 5,465,966, to La Savio. The Bellehumeur et al. reference uses a plurality of runners made of a low friction plastic or steel which are disposed about the outer periphery of each of the opposing sides of the puck body. The runners extend through the body of the puck, with the exposed portions of the runners each having a rounded head.

Hsieh uses a two-piece hard plastic main body having rounded bosses extending therefrom, with a layer made of soft plastic enveloping the main body and allowing only the bosses to extend therethrough. The Bruhm and Salcer et al. references teach a skeleton supporting a plurality of protuberances thereon, with the puck body being molded around this skeleton. The protuberances, which form the runners, are rounded in the Bruhm reference and of a rounded oval configuration in the Salcer et al. reference.

The Bellehumeur '274 patent teaches the use of replaceable runners having a rounded head and a serrated shaft to retain them in apertures located in annular arrays in each of the opposing faces of the puck body. Such runners are also referred to in the industry as "puck rivets." In the Bellehumeur '274 patent, the head of each of the runners is partially located within a recess in the puck body. The La Savio reference in one embodiment teaches the use of cushioned small disks extending above each of the opposing faces of the puck body. While all of these references in the third group provide an improvement over a flat roller hockey puck made of plastic materials, they still do not glide on a paved surface as well as an ice hockey puck glides on ice.

The fourth approach, namely the use of larger area surfaces located on the opposite faces of the puck, is illustrated by the La Savio reference cited above and by U.S. Pat. No. 5,472,193, to Everman. In a second embodiment, the La Savio reference teaches the use of a cushioned large disk mounted above each of the opposing faces of the puck body. The Everman reference teaches the use of two large disks made of a low friction material which are mounted in parallel at opposite ends of a shaft. The hub (which essentially forms the body of the puck) is rotatably mounted on the shaft using a bearing member, and in one embodiment the hub has a metal ring located near the outer periphery thereof. While these two references in the fourth group also provide an improvement over a flat roller hockey puck made of plastic materials, they still do not glide on a paved surface as well as an ice hockey puck glides on ice.

It is accordingly the primary objective of the present invention that it provide a roller hockey puck which will glide relatively freely over the irregularities inherent in a paved surface, thereby exhibiting gliding more akin to an ice hockey puck on ice than to most roller hockey pucks on paved surfaces. It is a closely related objective of the roller hockey puck of the present invention that it exhibit the lowest possible coefficient of friction when gliding over a paved surface, and that it approach the low coefficient of friction exhibited by an ice hockey puck when gliding over ice as closely as is possible. It is a further related objective of the roller hockey puck of the present invention that it be highly resistant to any possible deterioration in its low coefficient of friction when gliding on a paved surface which deterioration results from use of the roller hockey puck.

It is an additional objective of the roller hockey puck of the present invention that it be highly resistant to wear while in use, and that those parts of the roller hockey puck which exhibit the most wear be quickly and easily replaceable. It is still another objective of the roller hockey puck of the present invention that, to the maximum extent possible, it behave like an ice hockey puck behaves on ice whenever it is hit. In this regard, it is a related objective that it exhibit similar stability to an ice hockey puck when it is hit, rather than flipping over easily and tumbling as several previously known roller hockey pucks are apt to do. It is yet another objective of the roller hockey puck of the present invention that it be of a size and weight which is similar to that of an ice hockey puck, namely three inches in diameter, one inch thick, and weighing approximately six ounces.

The roller hockey puck of the present invention must be of a construction which is both durable and long lasting, and it should also require essentially no maintenance, other than replacing the worn parts as previously mentioned. In order to enhance the market appeal of the roller hockey puck of the present invention, it should also be of inexpensive construction to thereby afford it the broadest possible market. Finally, it is also an objective that all of the aforesaid advantages and objectives of the roller hockey puck of the present invention be achieved without incurring any substantial relative disadvantage.

SUMMARY OF THE INVENTION

The disadvantages and limitations of the background art discussed above are overcome by the present invention. With this invention, a roller hockey puck is taught which uses at least one spherical roller or ball, with each spherical roller used being supported by bearings to make capable of rolling with a very low coefficient of friction. In the preferred embodiment roller hockey puck of the present invention, a single spherical roller is used.

The spherical roller is located inside a cavity which is centrally located within a puck body of conventional configuration, with the cavity having a centrally located circular opening in each of the opposing faces of the puck body. The spherical roller is retained in place within the cavity of the puck body by bearing members which rotatably support it in a position in which portions of the spherical roller extend slightly through each of the circular openings located in the opposing faces of the puck body. Thus, it will be appreciated by those skilled in the art that the roller hockey puck of the present invention is designed to allow it to roll on the spherical member.

It will also be appreciated by those skilled in the art that a roller hockey puck supported only by a single spherical roller as described thus far will be unstable. Accordingly, in the preferred embodiment a runner array is located in annular fashion on each of the opposing faces of the roller hockey puck of the present invention to prevent it from wobbling on the spherical roller. The preferred embodiment uses a single circular runner mounted on each of the opposing faces of the puck body closer to the side edges of the puck body than to the center of the opposing faces.

The circular runners extend out from their respective puck faces slightly less than the spherical roller extends out from the puck faces. In the preferred embodiment, the circular runners are replaceable and are mounted such that they are partially recessed into their respective puck faces. It will thus be appreciated that the spherical roller will be the primary means of support for the roller hockey puck of the present invention as it glides on a paved surface.

In the roller hockey puck of the present invention, an annular metal ring is molded into the puck body nearer the side edges thereof than to the center thereof. In the preferred embodiment, the annular metal ring is spaced midway between the opposing faces of the puck body. The annular metal ring functions to provide stability to the roller hockey puck of the present invention as it moves, and also may be used to weight it to the desired weight.

In the preferred embodiment, the bearing members include two spaced-apart annular bearing arrays located parallel to the faces of the roller hockey puck of the present invention. The bearing arrays may be supported by bearing support caps mounted into each face of the puck body, with the circular openings through which the spherical roller extends being located in the bearing support caps. Optionally, the bearing arrays may be mounted using a thin resilient washer between each of the bearing arrays and their respective bearing support caps. The resilient washers provide the spherical roller with a "spring suspension" to cushion impacts when the spherical roller hits the paved surface as an airborne roller hockey puck falls back onto the paved surface.

In the preferred embodiment, each of the bearing support caps is mounted to the puck body using hardware. Optionally, the bearing support caps may be constructed to allow them to screw together from opposite sides of the puck body, retaining the puck body therebetween.

In an alternate embodiment, the circular runners may be molded into the puck body. In another alternate embodiment, the circular runners may be replaced by arrays of runners mounted into the opposing faces of the roller hockey puck. The runners may be of the "puck rivet" type, with eight, for example, being used on each side of the roller hockey puck. In still another alternate embodiment, the runners may be arrays of rounded oval runners, each of which is supported by two serrated shafts.

In an alternate embodiment, the bearings may be located directly in the bearing support caps, rather than being discrete bearing arrays which are supported by the bearing support caps. In this embodiment, the bearing races are molded into the bearing support caps.

In another alternate embodiment, the bearing support caps may include an inwardly-projecting annular brush, with the free ends of the brush being close adjacent to the spherical roller as it extends outwardly from the opposing faces of the roller hockey puck. The annular brush acts to prevent dirt particles from entering the puck cavity in which the bearing members are located.

Other alternate embodiments include the use of multiple (three, for example) spherical rollers. These embodiments do not require the use of runners, since the multiple spherical rollers inherently provide stability to the roller hockey puck. In a first alternate embodiment, three bearing-mounted spherical rollers are used, with each spherical roller extending from both sides of the roller hockey puck. In a second alternate embodiment, spherical rollers which are pre-assembled into a combination race/cup containing bearings are used. Six of these assemblies may be used, with the spherical rollers from three assemblies extending from each opposing face of the puck body. The assemblies may also be biased using coil springs to provide a spring suspension.

It may therefore be seen that the present invention teaches a roller hockey puck which will glide relatively freely over the irregularities inherent in a paved surface, thereby gliding in a manner similar to the way an ice hockey puck glides on ice. The roller hockey puck of the present invention does so because of its low coefficient of friction even when gliding over a paved surface, approaching the low coefficient of friction exhibited by an ice hockey puck when gliding over ice as closely as is possible. The roller hockey puck of the present invention is highly resistant to deterioration in this low coefficient of friction due to its construction, which uses ball bearings to support its spherical rollers.

The roller hockey puck of the present invention is also highly resistant to use-related wear, and its runners, which will exhibit the most wear, are quickly and easily replaceable. Due to its design, the roller hockey puck of the present invention behaves remarkably like an ice hockey puck behaves on ice when it is hit. In this regard, the roller hockey puck of the present invention exhibits a high degree of stability when hit, not flipping over and tumbling as easily as previously known roller hockey pucks. Depending on the choice of materials used to manufacture the roller hockey puck of the present invention, it may also be of a similar size and weight to an ice hockey puck.

The roller hockey puck of the present invention is of a construction which is both durable and long lasting, and which will require essentially no maintenance, other than replacing the worn runners as needed. The roller hockey puck of the present invention is also of inexpensive construction to enhance its market appeal and to thereby afford it the broadest possible market. Finally, all of the aforesaid advantages and objectives of the roller hockey puck of the present invention are achieved without incurring any substantial relative disadvantage.

DESCRIPTION OF THE DRAWINGS

These and other advantages of the present invention are best understood with reference to the drawings, in which.

DETAILED DESCRIPTION OF THE PREFERRED EMBODIMENT

The preferred embodiment of the present invention, which is illustrated in FIGS. 1 through 14, uses a single spherical roller to support the puck body above a paved surface on which the roller hockey puck is gliding. To maintain the faces of the puck body above the paved surface, runners made of a material having a low coefficient of friction are disposed in an annular configuration on each of the opposing faces of the puck body. A variety of alternate embodiments illustrative of a number of different manners in which the principles of the present invention may be utilized will also be provided, particularly with regard to FIGS. 15 through 35.

Figure 1:
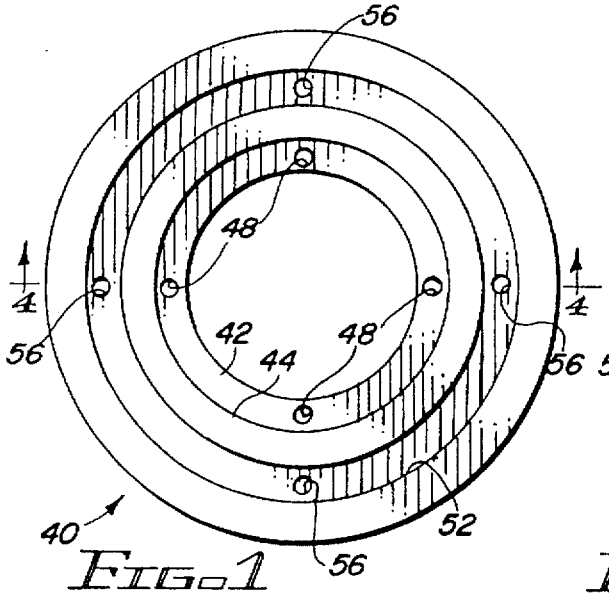
FIG. 1 is a top plan view of a puck body constructed in accordance with the teachings of the present invention, showing a centrally-located cavity extending through the puck body, an annular recess surrounding the cavity, and a shallow annular recess located near the outer edges of the puck body.
Figure 2:
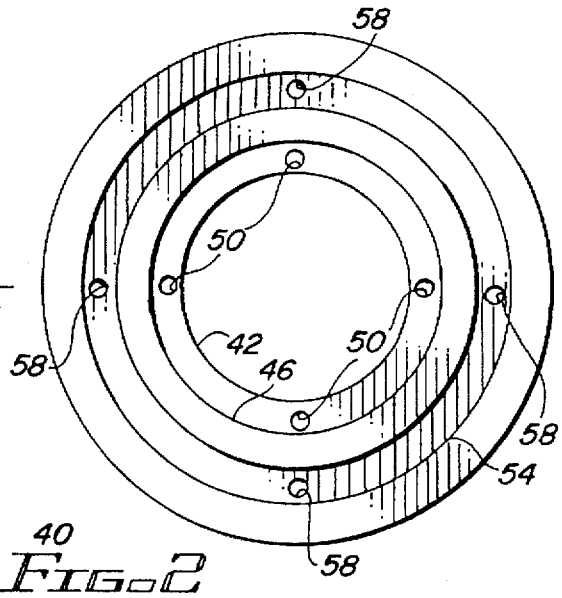
FIG. 2 is a bottom plan view of the puck body illustrated in FIG. 1, showing another annular recess surrounding the cavity, and another shallow annular recess located near the outer edges of the puck body.
Figure 3:
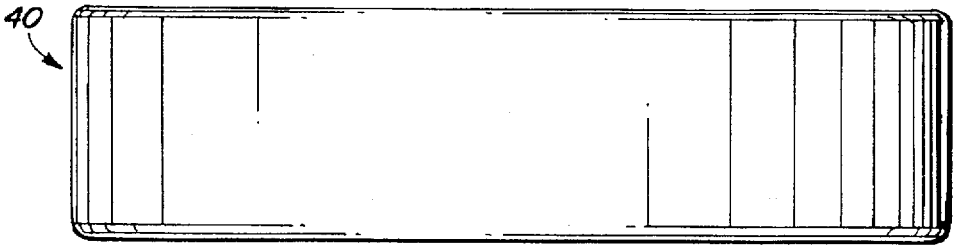
FIG. 3 is a side view of the puck body illustrated in FIGS. 1 and 2.

Referring first to FIGS. 1 through 4, a puck body 40 constructed in accordance with the teachings of the present invention is illustrated. The puck body 40 is essentially cylindrical in configuration, and it may be made of plastic material such as polyurethane or of rubber. The puck body 40 is preferably approximately the same size as a regulation ice hockey puck, which is three inches in diameter and one inch thick. The puck body 40 has a cylindrical cavity 42 which is centrally located therein and which extends therethrough, as best shown in FIGS. 1 and 2.

Figure 4:
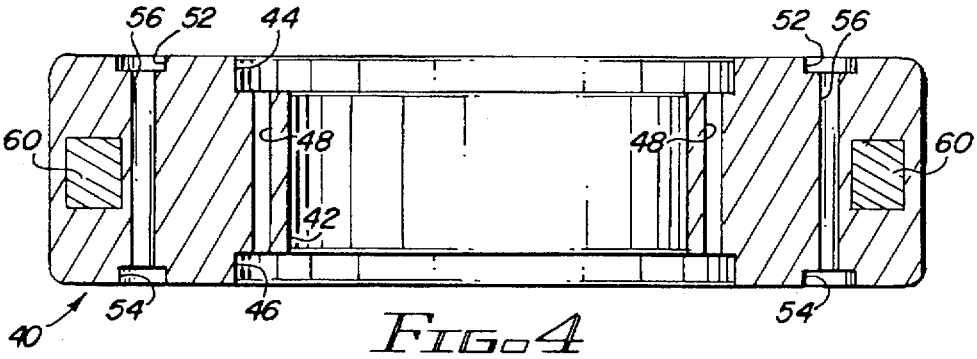
FIG. 4 is a cross-sectional view of the puck body illustrated in FIGS. 1 through 3, showing the depths of the annular recesses and the shallow annular recesses, and also showing an annular metal ring which is molded into the puck body near the side edges thereof.

Located in the opposing faces of the puck body 40 around the cavity 42 in the puck body 40 are annular recesses 44 and 46, the depths of which are best illustrated in FIG. 4. Four apertures 48 located in spaced-apart fashion extend between the bottom of the annular recess 44 and the bottom of the annular recess 46.

Located in the face of the puck body 40 shown in FIG. 1 near the outer edges thereof is a shallow annular recess 52, the depth of which is best illustrated in FIG. 4. Similarly, located in the face of the puck body 40 shown in FIG. 2 near the outer edges thereof is a shallow annular recess 54, the depth of which is best illustrated in FIG. 4. Four apertures 56 located in spaced-apart fashion extend between the bottom of the shallow annular recess 52 and the bottom of the shallow annular recess 54.

Referring now just to FIG. 4, an annular metal ring 60 is shown to be molded into the puck body 40. The annular metal ring 60 is spaced midway between the opposing faces of the puck body 40, and is located near the side edges of the puck body 40. The annular metal ring 60, which may be made of a relatively heavy metal such as steel or lead, provides stability to the roller hockey puck of the present invention as it moves. The weight of the annular metal ring 60 may also be used to weight the roller hockey puck to a desired weight, such as the regulation six ounces of an ice hockey puck.

The utility of the annular metal ring 60 may be described briefly as follows. As a pass is made, a roller hockey puck slides from the heel to the toe of a hockey stick, thereby putting a spin on the roller hockey puck. With the annular metal ring 60 being located around the outer edge of the puck body 40, the annular metal ring 60 will act like a gyroscope to help stabilize the roller hockey puck and prevent it from flipping and turning on edge. This is especially important when making a flip pass, in which the roller hock puck is lifted off of the paved surface and over an opposing player's stick (typically four to ten inches in the air), landing in front of a teammate's stick. When making such a pass, additional spin placed on the roller hockey puck of the present invention makes it stay flat during its flight, and also makes it land flat.

Figure 6:
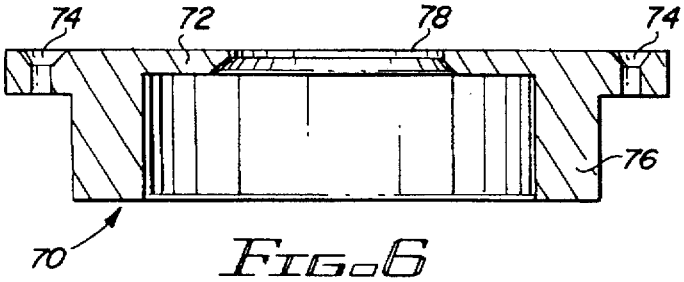
FIG. 6 is a cross-sectional view of the bearing support cap illustrated in FIG. 5, showing a hollow cylinder portion extending from the bottom side thereof around the circular opening therein.
Figure 5:
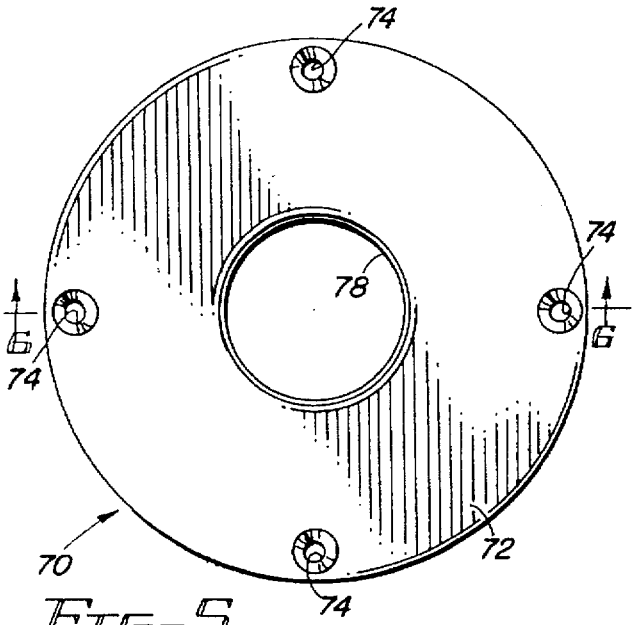
FIG. 5 is a plan view of a bearing support cap, one of which is for mounting in each of the opposing faces of the puck body illustrated in FIGS. 1 through 4, showing a centrally located circular opening therein.

Referring next to FIGS. 5 and 6, a bearing support cap 70 is shown; two of the bearing support caps 70 will be used in the preferred embodiment roller hockey puck of the present invention, one being mounted in each of the opposing faces of the puck body 40 illustrated in FIGS. 1 through 4. The top surface of the bearing support cap 70 consists of a circular plate 72 which is of a size to be received in either the annular recess 44 of the puck body 40 (which is illustrated in FIG. 1), or in the annular recess 46 of the puck body 40 (which is illustrated in FIG. 2).

The bearing support cap 70 has four apertures 74 which are located in spaced-apart fashion around the edge of the circular plate 72. The apertures 74 in the circular plate 72 of the bearing support cap 70 are located so as to be aligned either with the ends of the apertures 48 located in the annular recess 44 of the puck body 40 (which is illustrated in FIG. 1), or with the ends of the apertures 48 located in the annular recess 46 of the puck body 40 (which is illustrated in FIG. 2). Note that the apertures 74 are countersunk on the top side of the bearing support cap 70.

The bearing support cap 70 has a cylindrical segment 76 extending from the bottom of the circular plate 72. The circular plate 72 of the bearing support cap 70 has a centrally located circular opening 78 located therein. The circular opening 78 is tapered to widen on the inside of the circular plate 72 to closely fit a spherical roller (not illustrated in FIGS. 5 or 6), as will become apparent with respect to the discussion of FIG. 13 below. The circular opening 78 is also tapered to widen on the outside of the circular plate 72 slightly, to prevent the inside of the circular opening 78 from being damaged and contacting the spherical roller.

Figure 8:
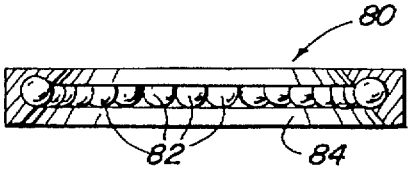
FIG. 8 is a cross-sectional view of the annular bearing array illustrated in FIG. 7.
Figure 7:
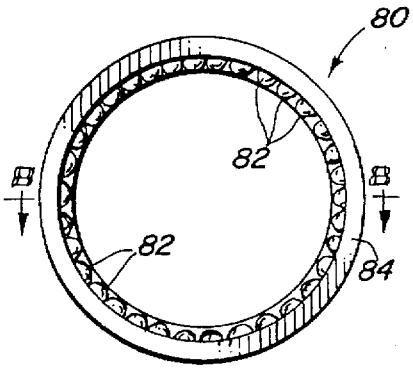
FIG. 7 is a plan view of an annular bearing array including ball bearings mounted in an annular race member, the annular bearing array for mounting in the bearing support cap illustrated in FIG. 5 and 6.

Referring now to FIGS. 7 and 8, an annular bearing array 80 is illustrated which includes a plurality of ball bearings 82 mounted in an annular race member 84. The ball bearings 82 and the annular race member 84 may each be made of either metal or plastic, with the ball bearings 82 being installed in the annular race member 84 by pressing them in. Once the ball bearings 82 are so inserted into the annular race member 84, they will be retained therein, it being understood that they are free to move around the annular race member 84. The outer diameter of the annular race member 84 is sized to closely fit the interior diameter of the cylindrical segment 76 of the bearing support cap 70 (illustrated in FIG. 6).

Figure 9:
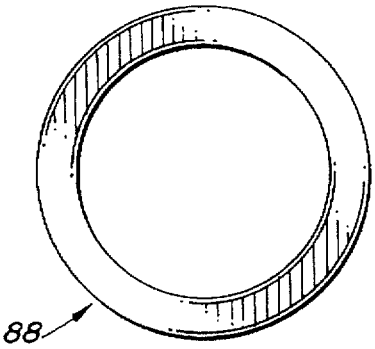
FIG. 9 is a plan view of a thin, annular resilient washer for mounting between the annular bearing array illustrated in FIGS. 7 and 8 and the bearing support cap illustrated in FIGS. 5 and 6.
Figure 10:
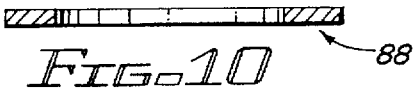
FIG. 10 is a cross-sectional view of the resilient washer illustrated in FIG. 9.

Referring next to FIGS. 9 and 10, a thin, annular resilient washer 88 for installation between the annular race member 84 of the annular bearing array 80 illustrated in FIGS. 7 and 8 and the bearing support cap illustrated in FIG. 6 is illustrated. The resilient washer 88 has inner and outer diameters which are approximately the same as the inner and outer diameters of the portion of the annular race member 84 which will bear against the resilient washer 88 when both are installed within the cylindrical segment 76 of the bearing support cap 70 adjacent to the circular plate 72. The resilient washer 88 is preferably made of a resilient foam material such that it may be compressed somewhat, at which time it will urge the annular bearing array 80 away from the interior of the circular plate 72.

Figure 11:
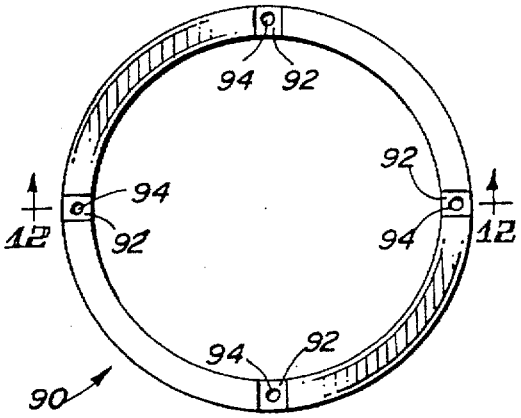
FIG. 11 is a top plan view of a circular runner, showing the location of apertures which will be used to mount one of the circular runners in each of the shallow annular recesses of the puck body illustrated in FIGS. 1 through 4.
Figure 12:
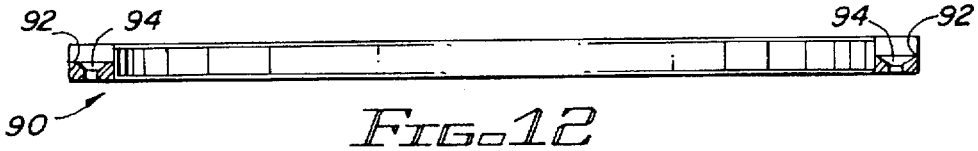
FIG. 12 is a cross-sectional view of the circular runner illustrated in FIG. 11, showing the recessed area around the apertures.

Referring now to FIGS. 11 and 12, an annular circular runner 90 which will be used with the roller hockey puck of the present invention to provide a low friction gliding surface and to stabilize the roller hockey puck as it glides over a paved surface is illustrated. The circular runner 90 is of a size to fit partially into either of the shallow annular recesses 52 and 54 in the puck body 40 illustrated in FIGS. 1, 2, and 4. Both the top and bottom surfaces of the circular runner 90 are flat, with four recessed areas 92 being located in the top surface of the circular runner 90 at 90 degree intervals.

A countersunk aperture 94 is centrally located in each of the recessed areas 92, with the countersunk apertures 94 being located so as to be aligned with the apertures 56, either in the shallow annular recess 52 on one side of the puck body 40, or in the shallow annular recess 54 on the other side of the puck body 40. The circular runner 90 is preferably made of a durable material having a very low coefficient of friction, such as, for example, a selected fluoropolymer such as polytetrafluoroethylene, such as the material marketed by DuPont under the trademark TEFLON, a synthetic polymide such as nylon, or another hard plastic material. Note that other types of runners could be used instead of the circular runner 90, and such alternate types of runners are mentioned later in this specification. Similarly, other manners of affixing a circular runner could also be used, and one alternate technique for doing so is also mentioned later in this specification.

Figure 13:
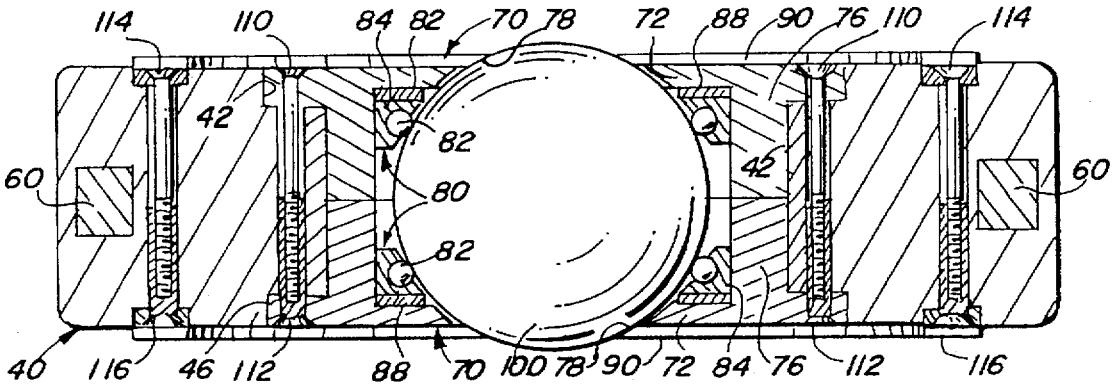
FIG. 13 is a cross-sectional view of the puck body illustrated in FIGS. 1 through 4, with a spherical roller mounted therein using two of the annular bearing arrays illustrated in FIGS. 7 and 8, two of the resilient washers illustrated in FIGS. 9 and 10, and two of the bearing support caps illustrated in FIGS. 5 and 6.
Figure 14:
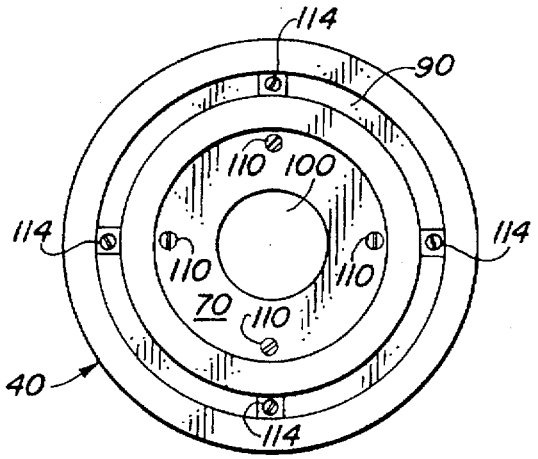
FIG. 14 is a plan view of one side of the assembled roller hockey puck illustrated in FIG. 13.

Referring next to FIGS. 13 and 14, the assembly of the various parts illustrated in FIGS. 1 through 12 together with a spherical roller 100 to make the roller hockey puck of the present invention is illustrated. The spherical roller 100 is of a diameter larger than the thickness of the puck body 40, such than when the spherical roller 100 is installed inside the puck body 40, it extends both above and below the puck body 40. The spherical roller 100 is made of a tough, durable material such as a hard plastic like nylon, delrin, polypropylene, or polyurethane, or a high density hard rubber material.

The roller hockey puck illustrated in FIGS. 13 and 14 is assembled in the following manner. A resilient washer 88 is placed into the cylindrical segment 76 of the bearing support cap 70 adjacent the inside of the circular plate 72. An annular bearing array 80 is then placed into the cylindrical segment 76 of the bearing support cap 70 on top of the resilient washer 88. The bearing support cap 70 is then placed into one side of the puck body 40, with the cylindrical segment 76 of the bearing support cap 70 fitting into the cavity 42 in the puck body 40, and the circular plate 72 of the bearing support cap 70 fitting into the annular recess 44 in the puck body 40.

The spherical roller 100 is then placed into the cavity 42 in the puck body 40. Another resilient washer 88 is then placed into the cylindrical segment 76 of another bearing support cap 70 adjacent the inside of the circular plate 72. Another annular bearing array 80 is then placed into the cylindrical segment 76 of the bearing support cap 70 on top of the resilient washer 88. The bearing support cap 70 is then placed into the other side of the puck body 40 to retain the spherical roller 100 therein, with the cylindrical segment 76 of the bearing support cap 70 fitting into the cavity 42 in the puck body 40, and the circular plate 72 of the bearing support cap 70 fitting into the annular recess 46 in the puck body 40.

Four flat-head bolts 110 are inserted through the apertures 74 in the bearing support cap 70, and then into the apertures 48 in the puck body 40. Four flat-head female bolts 112 (female bolts have a hollow cylinder extending therefrom with a threaded interior in the hollow cylinder) are inserted through the apertures 74 in the bearing support cap 70, and are then into the apertures 48 in the puck body 40. The flat-head bolts 110 are then screwed into the flat-head female bolts 112.

A circular runner 90 is then placed into the shallow annular recess 52 on one side of the puck body 40. Another circular runner 90 is then placed into the shallow annular recess 54 on the other side of the puck body 40. Four flat-head bolts 114 are inserted through the countersunk apertures 94 in the circular runner 90 in the shallow annular recess 52, and then into one end of the apertures 56 in the puck body 40. Four flat-head female bolts 116 are inserted through the countersunk apertures 94 in the circular runner 90 in the shallow annular recess 54, and then into the other end of the apertures 56 in the puck body 40. The flat-head bolts 114 are then screwed into the flat-head female bolts 116.

Note that when the preferred embodiment roller hockey puck of the present invention is assembled, the spherical roller 100 will extend slightly above the level of the circular runners 90 on each side of the roller hockey puck. The spherical roller 100 will be mounted between the two annular bearing arrays 80 in the roller hockey puck, and will be able to move quite freely. When the roller hockey puck of the present invention is airborne and falls to the paved surface on one side of the spherical roller 100, the resilient washer 88 furthest from the paved surface will momentarily compress, and then spring back to its normal configuration, thereby acting as a resilient suspension.

Figure 15:
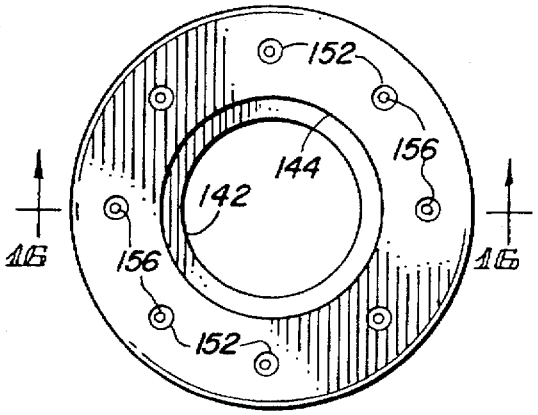
FIG. 15 is a plan view of an alternate embodiment puck body, showing a plurality of small, shallow circular recesses located in a circular array near the outer edges of the puck body.
Figure 16:
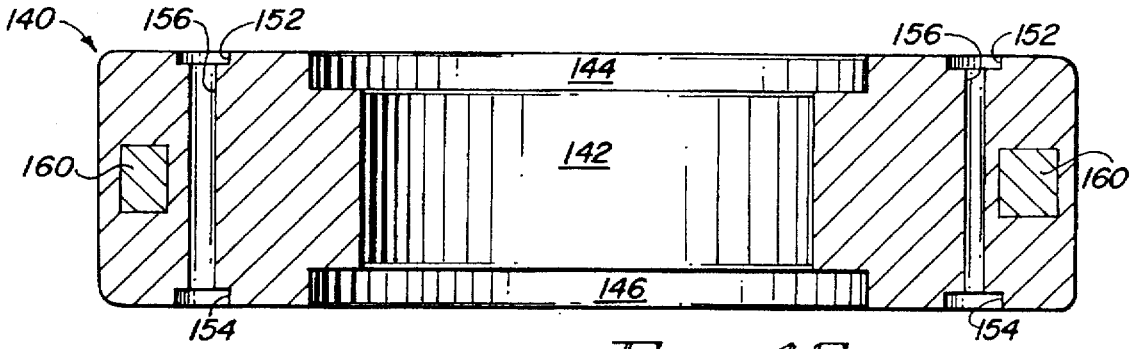
FIG. 16 is a cross-sectional view of the puck body illustrated in FIG. 15, showing the depths of the circular recesses.

Referring next to FIGS. 15 and 16, an alternate embodiment puck body 140 is illustrated. The puck body 140 is similar in configuration to the puck body 40 illustrated in FIGS. 1 through 4, and has a cylindrical cavity 142 which is centrally located therein and which extends therethrough. Located in the opposing faces of the puck body 140 around the cavity 142 in the puck body 140 are annular recesses 144 and 146, the depths of which are best illustrated in FIG. 16. Note that in the puck body 140, no apertures are located in either the bottom of the annular recess 144 or the bottom of the annular recess 146.

Located in one face of the puck body 140 near the outer edges thereof are eight small, shallow circular recesses 152 located in a circular (or annular) array near the outer edges of the puck body 140. Located in the opposing face of the puck body 140 near the outer edges thereof are eight small, shallow circular recesses 154 located in a circular (or annular) array near the outer edges of the puck body 140. An aperture 156 extends between each of the shallow circular recesses 152 and a corresponding oppositely located one of the shallow circular recesses 154, with the ends of the apertures 156 being centrally located in the bottoms of the shallow circular recesses 152 and 154.

Referring now just to FIG. 16, an annular metal ring 160 is shown to be molded into the puck body 140. The annular metal ring 160 is spaced midway between the opposing faces of the puck body 140, and is located near the side edges of the puck body 140.

Figure 17:
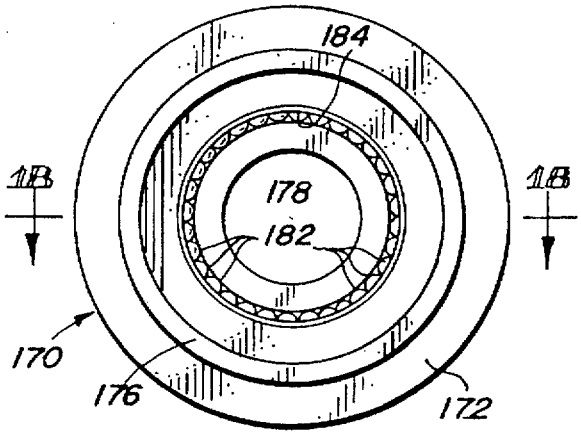
FIG. 17 is a bottom plan view of an alternate embodiment female bearing support cap for mounting in one of the opposing faces of the puck body illustrated in FIGS. 15 and 16, showing bearings located in an annular array in a bearing race molded into the female bearing support cap.
Figure 18:
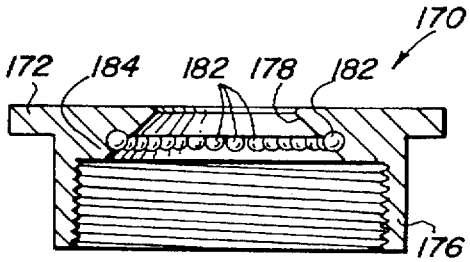
FIG. 18 is a cross-sectional view of the female bearing support cap illustrated in FIG. 17.

Referring next to FIGS. 17 and 18, an alternate embodiment female bearing support cap 170 is shown. The top surface of the female bearing support cap 170 consists of a circular plate 172 which is of a size to be received in either the annular recess 144 of the puck body 140 (illustrated in FIGS. 15 and 16) or in the annular recess 146 of the puck body 140. The female bearing support cap 170 has a cylindrical segment 176 extending from the bottom of the circular plate 172, which is threaded on the inside thereof.

The circular plate 172 of the female bearing support cap 170 has a centrally located circular opening 178 located therein. The circular opening 178 is tapered to widen on the inside of the circular plate 172 to closely fit the spherical roller 100 (not illustrated in FIGS. 17 or 18), as will become apparent with respect to the discussion of FIG. 22 below. The circular opening 178 is also tapered to widen on the outside of the circular plate 172 slightly, to prevent the inside of the circular opening 178 from being damaged and contacting the spherical roller 100.

An annular bearing array is illustrated which includes a plurality of ball bearings 182 mounted in an annular race member 184 which is built into the female bearing support cap 170 on the inside of the circular plate 172 and inside the cylindrical segment 176. The ball bearings 182 are installed in the annular race member 184 by pressing them in. Once the ball bearings 182 are so inserted in the annular race member 184, they will be retained therein, it being understood that they are free to move around the annular race member 184.

Figure 20:
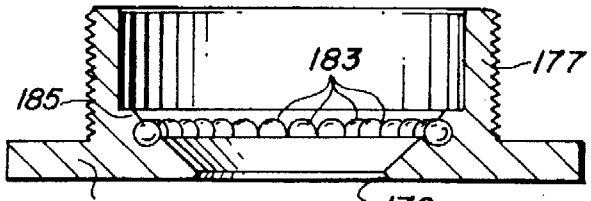
FIG. 20 is a cross-sectional view of the male bearing support cap illustrated in FIG. 19.
Figure 19:
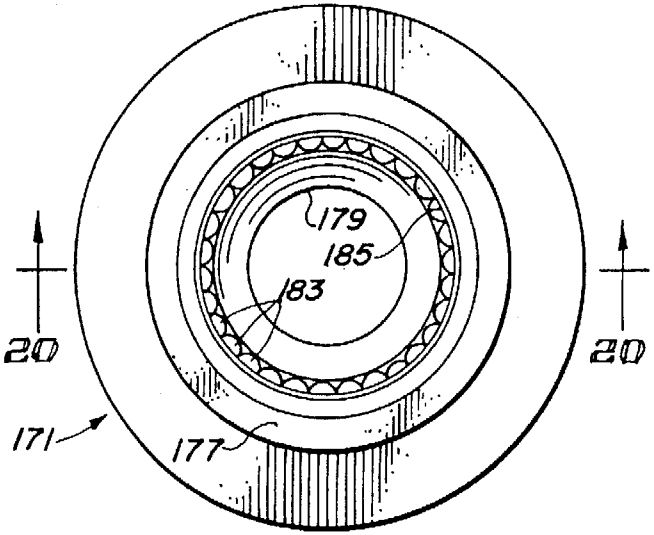
FIG. 19 is a bottom plan view of an alternate embodiment male bearing support cap for mounting in the other of the opposing faces of the puck body illustrated in FIGS. 15 and 16, showing bearings located in an annular array in a bearing race molded into the male bearing support cap.

Referring now to FIGS. 19 and 20, an alternate embodiment male bearing support cap 171 is shown. The top surface of the male bearing support cap 171 consists of a circular plate 173 which is of a size to be received in either the annular recess 144 of the puck body 140 (illustrated in FIGS. 15 and 16) or in the annular recess 146 of the puck body 140. The male bearing support cap 171 has a cylindrical segment 177 extending from the bottom of the circular plate 173, which is threaded on the outside thereof.

The circular plate 173 of the male bearing support cap 171 has a centrally located circular opening 179 located therein. The circular opening 179 is tapered to widen on the inside of the circular plate 173 to closely fit the spherical roller 100 (not illustrated in FIGS. 19 or 20), as will become apparent with respect to the discussion of FIG. 22 below. The circular opening 179 is also tapered to widen on the outside of the circular plate 173 slightly, to prevent the inside of the circular opening 179 from being damaged and contacting the spherical roller 100.

An annular bearing array is illustrated which includes a plurality of ball bearings 183 mounted in an annular race member 185 which is built into the male bearing support cap 171 on the inside of the circular plate 173 and inside the cylindrical segment 177. The ball bearings 183 are installed in the annular race member 185 by pressing them in. Once the ball bearings 183 are so inserted in the annular race member 185, they will be retained therein, it being understood that they are free to move around the annular race member 185.

Figure 21:
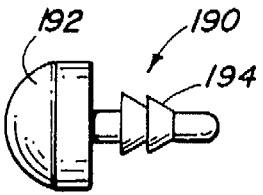
FIG. 21 is a side view of an alternate embodiment runner of the "puck rivet" type, showing a rounded circular head which is supported by a serrated shaft.

Referring next to FIG. 21, an alternate embodiment runner 190 of the "puck rivet" type is illustrated. The runner 190 has a rounded circular head 192, which is supported by a serrated shaft 194. The runner 190 is preferably made of a durable material having a very low coefficient of friction, such as, for example, a selected fluoropolymer such as polytetrafluoroethylene, such as the material marketed by DuPont under the trademark TEFLON, a synthetic polymide such as nylon, or another hard plastic material.

Figure 22:
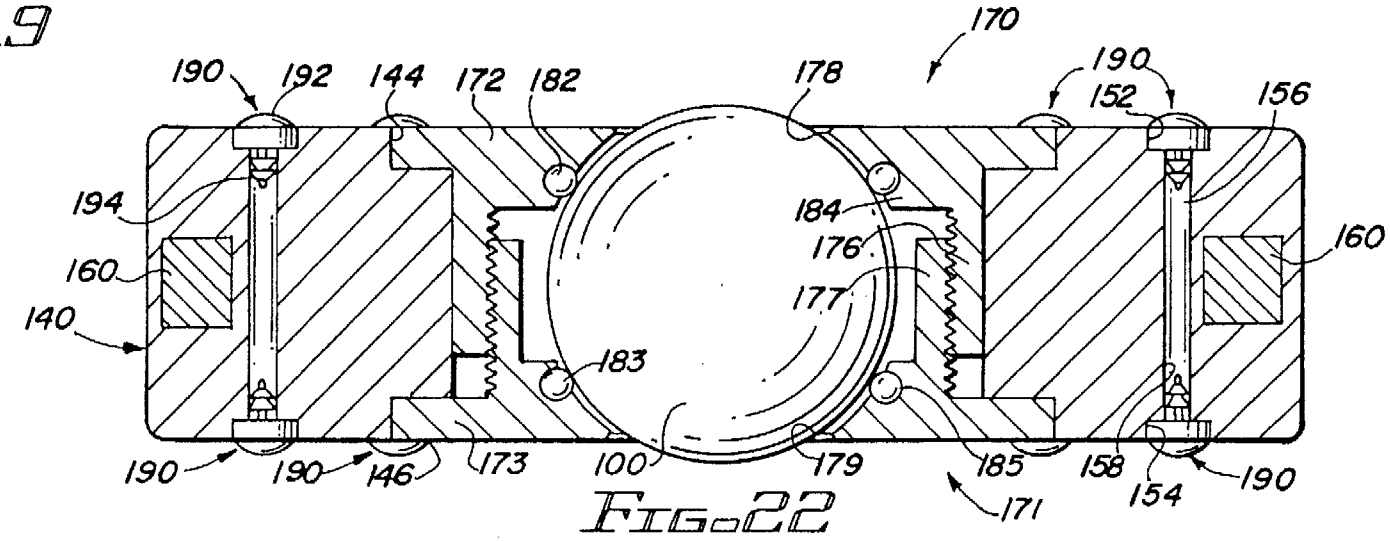
FIG. 22 is a cross-sectional view of the puck body illustrated in FIGS. 15 and 16, with the male bearing support cap illustrated in FIGS. 19 and 20 and the female bearing support cap illustrated in FIGS. 17 and 18 screwed together from opposite sides of the puck body to retain a spherical roller in the bearing arrays located therein.
Figure 23:
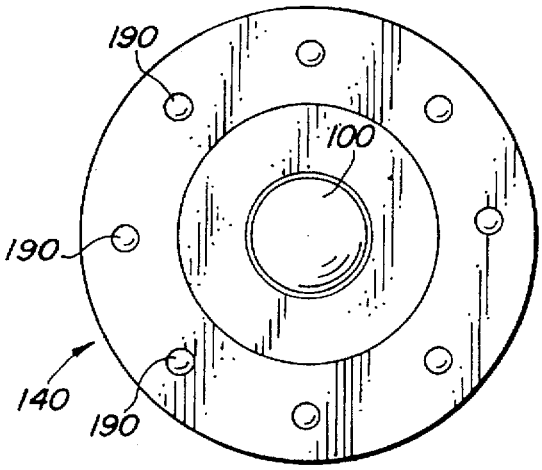
FIG. 23 is a plan view of one side of the assembled roller hockey puck illustrated in FIG. 22, showing the runners illustrated in FIG. 21 installed on the face of the puck body in an annular array.

Referring now to FIGS. 22 and 23, the assembly of the various parts illustrated in FIGS. 15 through 21 together with the spherical roller 100 to make an alternate embodiment roller hockey puck is illustrated. The female bearing support cap 170 is then placed into one side of the puck body 140, with the cylindrical segment 176 of the female bearing support cap 170 fitting into the cavity 142 in the puck body 140, and the circular plate 172 of the female bearing support cap 170 fitting into the annular recess 144 in the puck body 140.

The spherical roller 100 is then placed into the cavity 142 in the puck body 140. The male bearing support cap 171 is then placed into the other side of the puck body 140 to retain the spherical roller 100 therein, with the cylindrical segment 177 of the male bearing support cap 171 fitting into the cavity 142 in the puck body 140, and the circular plate 173 of the bearing support cap 171 fitting into the annular recess 146 in the puck body 140.

The outwardly threaded cylindrical segment 177 of the male bearing support cap 171 may then be screwed tightly into the inwardly threaded cylindrical segment 176 of the female bearing support cap 170, thereby retaining the female bearing support cap 170 and the male bearing support cap 171 in place with the puck body 140 located therebetween, with the spherical roller 100 being located inside the puck body 140.

Eight of the runners 190 are then mounted by inserting the serrated shafts 194 into the ends of the apertures 156 in one side of the puck body 140, with the rounded circular heads 192 being partially installed in the shallow circular recesses 152. Similarly, eight of the runners 190 are then mounted by inserting the serrated shafts 194 into the ends of the apertures 156 in the other side of the puck body 140, with the rounded circular heads 192 being partially installed in the shallow circular recesses 154. By having the apertures 156 extend through the puck body 140, a runner 190 having a broken-off rounded circular head 192 may be removed by removing the corresponding runner 190 on the opposite face of the puck body 140, and then inserting a small rod (not shown) through the aperture 156 to remove the broken-off serrated shaft 194.

Note that when the alternate embodiment roller hockey puck illustrated in FIGS. 22 and 23 is assembled, the spherical roller 100 will extend slightly above the level of the runners 190 on each side of the alternate embodiment roller hockey puck. The spherical roller 100 will be mounted between the two annular bearing arrays in the alternate embodiment roller hockey puck, and will be able to move quite freely.

Figure 24:
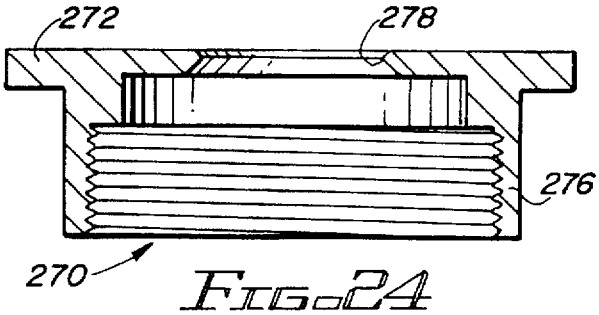
FIG. 24 is a cross-sectional view of another alternate embodiment female bearing support cap for mounting in one of the opposing faces of the puck body illustrated in FIGS. 15 and 16, showing a location into which the resilient washer illustrated in FIGS. 9 and 10 and the annular bearing array illustrated in FIGS. 7 and 8 may be placed.

Referring next to FIG. 24, another alternate embodiment female bearing support cap 270 is shown. The top surface of the female bearing support cap 270 consists of a circular plate 272 which is of a size to be received in either the annular recess 144 of the puck body 140 (illustrated in FIGS. 15 and 16) or in the annular recess 146 of the puck body 140. The female bearing support cap 270 has a cylindrical segment 276 extending from the bottom of the circular plate 272, which is threaded on the inner portion thereof. The portion of the cylindrical segment 276 immediately adjacent the circular plate 272 is cylindrical, and is designed to hold a resilient washer 88 (illustrated in FIGS. 9 and 10) and an annular bearing array 80 (illustrated in FIGS. 7 and 8) therein.

The circular plate 272 of the female bearing support cap 270 has a centrally located circular opening 278 located therein. The circular opening 278 is tapered to widen on the inside of the circular plate 272 to closely fit the spherical roller 100 (not illustrated in FIG. 24). The circular opening 278 is also tapered to widen on the outside of the circular plate 272 slightly, to prevent the inside of the circular opening 278 from being damaged and contacting the spherical roller 100.

Figure 25:
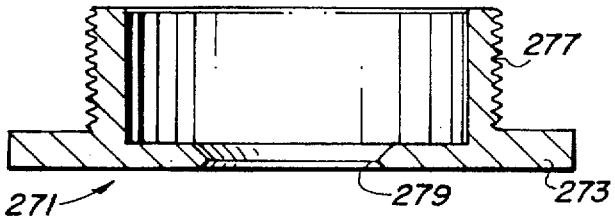
FIG. 25 is a cross-sectional view of another alternate embodiment male bearing support cap for mounting in the other of the opposing faces of the puck body illustrated in FIGS. 15 and 16, showing a location into which the resilient washer illustrated in FIGS. 9 and 10 and the annular bearing array illustrated in FIGS. 7 and 8 may be placed.

Referring now to FIG. 25, another alternate embodiment male bearing support cap 271 is shown. The top surface of the male bearing support cap 271 consists of a circular plate 273 which is of a size to be received in either the annular recess 144 of the puck body 140 (illustrated in FIGS. 15 and 16) or in the annular recess 146 of the puck body 140. The male bearing support cap 271 has a cylindrical segment 277 extending from the bottom of the circular plate 273, which is threaded on the outside thereof. The inner portion of the cylindrical segment 277 adjacent the circular plate 273 is cylindrical, and is designed to hold a resilient washer 88 (illustrated in FIGS. 9 and 10) and an annular bearing array 80 (illustrated in FIGS. 7 and 8) therein.

The circular plate 273 of the male bearing support cap 271 has a centrally located circular opening 279 located therein. The circular opening 279 is tapered to widen on the inside of the circular plate 273 to closely fit the spherical roller 100 (not illustrated in FIG. 25). The circular opening 279 is also tapered to widen on the outside of the circular plate 273 slightly, to prevent the inside of the circular opening 279 from being damaged and contacting the spherical roller 100.

The assembly of the female bearing support cap 270 and the male bearing support cap 271 is identical to that described in FIGS. 22 and 23, except that a resilient washer 88 and an annular bearing array 80 are placed into each of the cylindrical segment 276 of the female bearing support cap 270 and the cylindrical segment 277 of the male bearing support cap 271 prior to their assembly together on the puck body 140 with the spherical roller 100 located therebetween.

Figure 26:
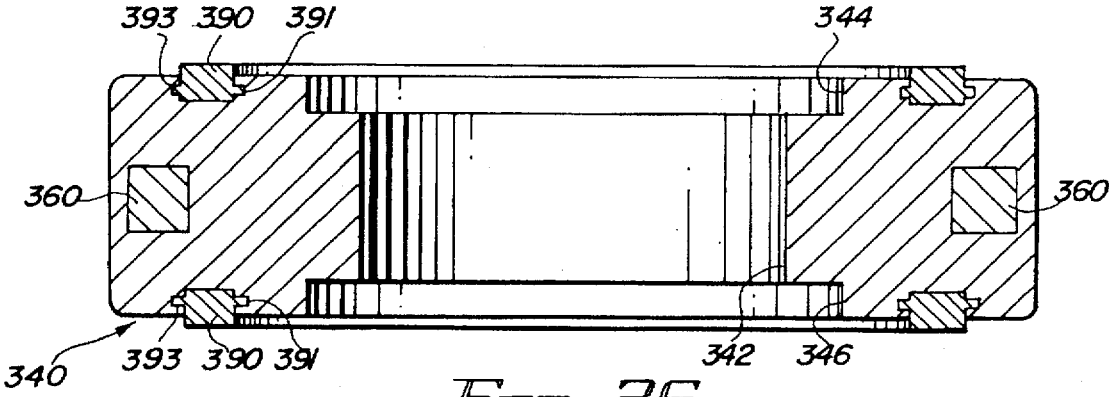
FIG. 26 is a cross-sectional view of an alternate embodiment puck body which two alternate embodiment circular runners have been molded into, showing how the circular runners project from the faces of the puck body.

Referring next to FIG. 26, an alternate embodiment puck body 340 is illustrated. The puck body 340 is similar in configuration to the puck body 40 illustrated in FIG. 4 and the puck body 140 illustrated in FIG. 16, and has a cylindrical cavity 342 which is centrally-located therein and which extends therethrough. Located in the opposing faces of the puck body 340 around the cavity 342 in the puck body 340 are annular recesses 344 and 346. An annular metal ring 360 is shown to be molded into the puck body 340. The annular metal ring 360 is spaced midway between the opposing faces of the puck body 340, and is located near the side edges of the puck body 340.

A circular runner 390 is molded into each of the opposing faces of the puck body 340 near the outer edges thereof. The circular runners 390 illustrated each have small annular flanges 391 and 393 extending respectively from the inside diameter and the outside diameter of the portion of the circular runner 390 which is located beneath the surface of the puck body 340. These annular flanges 391 and 393 act to retain the circular runners 390 within the puck body 340, and prevent them from coming out of the puck body 340 due to the forces exerted on the roller hockey puck when it is hit or strikes the playing surface, a goal post, or the boards of a hockey rink.

Note that, like the preferred embodiment of roller hockey puck of the present invention illustrated in FIGS. 13 and 14, when the alternate embodiment roller hockey puck shown in FIG. 26 is assembled, the spherical roller 100 will extend slightly above the level of the circular runners 390 on each side of the roller hockey puck. The circular runners 390 are preferably made of a durable material having a very low coefficient of friction, such as, for example, a selected fluoropolymer such as polytetrafluoroethylene, such as the material marketed by DuPont under the trademark TEFLON, a synthetic polymide such as nylon, or another hard plastic material.

Figure 27:
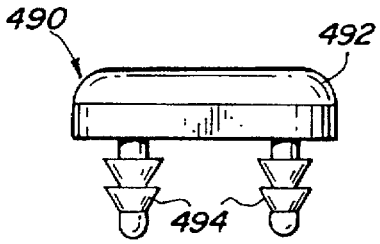
FIG. 27 is a side view of another alternate embodiment runner, which has a rounded oval runner supported by two serrated shafts.
Figure 28:
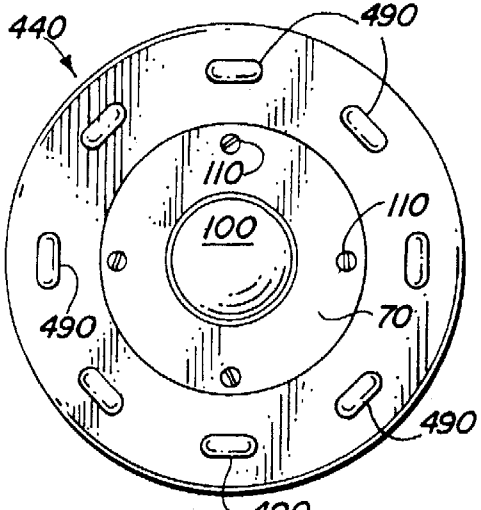
FIG. 28 is a plan view of one side of an assembled roller hockey puck, showing the runners illustrated in FIG. 27 installed on the face of the puck body in an annular array.

Referring now to FIG. 27, another alternate embodiment runner 490 of a modified "puck rivet" type is illustrated. The runner 490 has a rounded oval head 492, which is supported by two spaced-apart serrated shafts 494. The runner 490 is preferably made of a durable material having a very low coefficient of friction, such as, for example, a selected fluoropolymer such as polytetrafluoroethylene, such as the material marketed by DuPont under the trademark TEFLON, a synthetic polymide such as nylon, or another hard plastic material. Referring to FIG. 28, an alternate embodiment puck body 440 is illustrated with eight of the oval runners 490 installed thereon.

Figure 29:
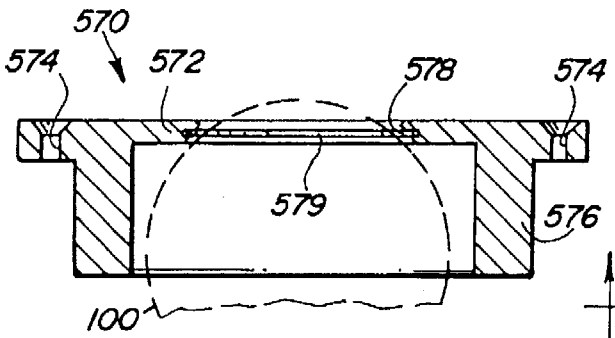
FIG. 29 is a cross-sectional view of another alternate embodiment bearing support cap having an inwardly-projecting annular brush located in the circular opening, the free ends of the brush being oriented to extend close adjacent the spherical roller shown in phantom lines.

Referring next to FIG. 29, an alternate embodiment bearing support cap 570 is illustrated. The top surface of the bearing support cap 570 consists of a circular plate 572 which is of a size to be received in either the annular recess 44 of the puck body 40 (which is illustrated in FIG. 1), or in the annular recess 46 of the puck body 40 (which is illustrated in FIG. 2).

The bearing support cap 570 has four apertures 574 which are located in spaced-apart fashion around the edge of the circular plate 572. The apertures 574 in the circular plate 572 of the bearing support cap 570 are located so as to be aligned either with the ends of the apertures 48 located in the annular recess 44 of the puck body 40 (which is illustrated in FIG. 1), or with the ends of the apertures 48 located in the annular recess 46 of the puck body 40 (which is illustrated in FIG. 2). Note that the apertures 574 are countersunk on the top side of the bearing support cap 570.

The bearing support cap 570 has a cylindrical segment 576 extending from the bottom of the circular plate 572. The circular plate 572 of the bearing support cap 570 has a centrally located circular opening 578 located therein. The circular opening 578 is tapered to widen on the inside of the circular plate 572 to closely fit the spherical roller 100, which is shown in phantom lines. The circular opening 578 is also tapered to widen on the outside of the circular plate 572 slightly, to prevent the inside of the circular opening 578 from being damaged and contacting the spherical roller 100.

The bearing support cap 570 has an inwardly-projecting annular brush member 579 located in the circular opening 578, the free ends of the annular brush member 579 being oriented to extend close adjacent the spherical roller 100 shown in phantom lines. The annular brush member 579 may be molded into the bearing support cap 570.

Figure 30:
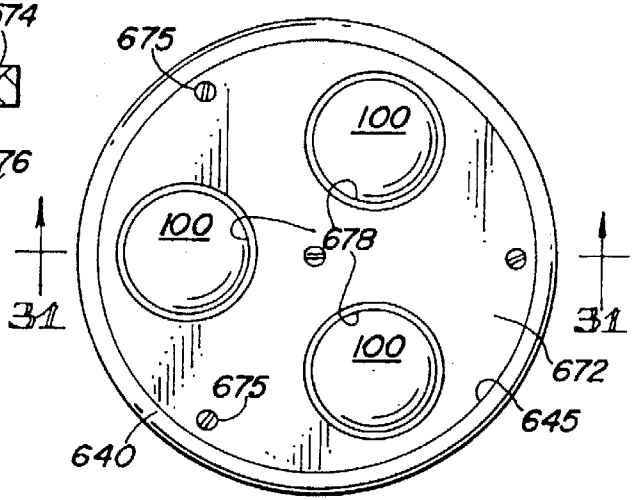
FIG. 30 is a plan view of an alternate embodiment roller hockey puck in which three spherical rollers are used.
Figure 31:
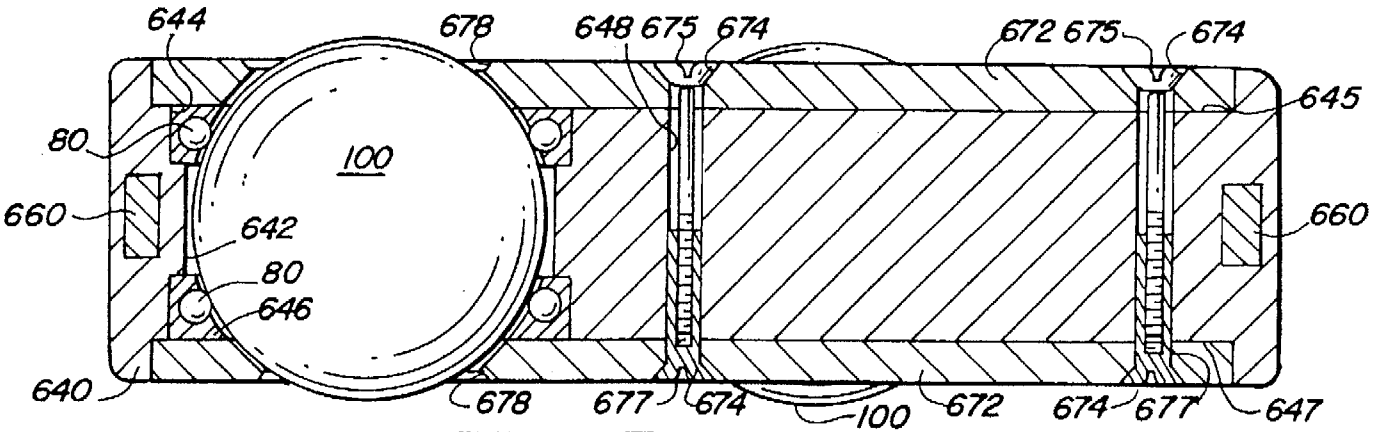
FIG. 31 is a cross-sectional view of the roller hockey puck illustrated in FIG. 30.

Referring next to FIGS. 30 and 31, an alternate embodiment roller hockey puck is illustrated in which three spherical rollers 100 and three pairs of the annular bearing arrays 80 are used. The alternate embodiment roller hockey puck uses a puck body 640 which has three cylindrical cavities 642, the locations of which are disposed in and extend through the puck body 640 at the locations in which the spherical rollers 100 are shown in FIG. 30. One of the cavities 642 in the puck body 640 is illustrated in FIG. 31. Located in the opposing faces of the puck body 640 around each of the cavities 642 in the puck body 640 are annular recesses 644 and 646, the depths of which are illustrated in FIG. 31.

Located in each of the opposing faces of the puck body 640 just inside the side edges of the puck body 640 are large circular recesses 645 and 647. Note that the puck body 640 has four apertures 648 extending between the large circular recesses 645 and 647, only two of which are illustrated in FIG. 31. Also shown in FIG. 31 is an annular metal ring 660, which is molded into the puck body 640 midway between the opposing faces and near to the side edges of the puck body 640. Since no runners are used with the alternate embodiment roller hockey puck illustrated in FIGS. 30 and 31, no recesses for runners are required.

The three spherical rollers 100 are each placed into one of the cavities 642 in the puck body 640, and annular bearing arrays 80 are then placed into each of the annular recesses 644 and 646. A circular bearing support cover 672 is then installed into each of the large circular recesses 645 and 647. The circular bearing support covers 672 each have four countersunk apertures 674 which are located therein, only two of which are illustrated in FIG. 31.

The circular bearing support covers 672 each have three circular openings 678 located therein at the locations of the cavities 642 in the puck body 640. The circular openings 678 are tapered to widen on the inside of the circular bearing support covers 672 to closely fit the spherical rollers 100. Note that although resilient washers 88 (illustrated in FIGS. 9 and 10) are not used in the embodiment illustrated in FIGS. 30 and 31, they could be if so desired.

A flat-head bolt 675 is inserted into each of the apertures 674 in one of the circular bearing support covers 672, and then into the corresponding one of the apertures 648 in the puck body 640. A flat-head female bolt 677 is inserted into each of the apertures 674 in the other of the circular bearing support covers 672, and then into the corresponding one of the apertures 648 in the puck body 640. The flat-head bolts 675 are then screwed into the flat-head female bolts 677, thereby retaining the circular bearing support covers 672 on the puck body 640.

Figure 32:
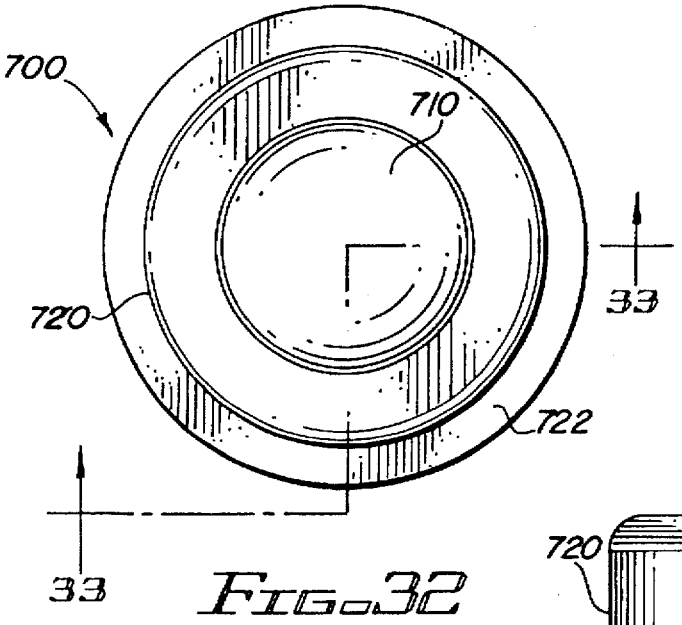
FIG. 32 is a top plan view of a spherical roller which is pre-assembled into a combination race/cup.
Figure 33:
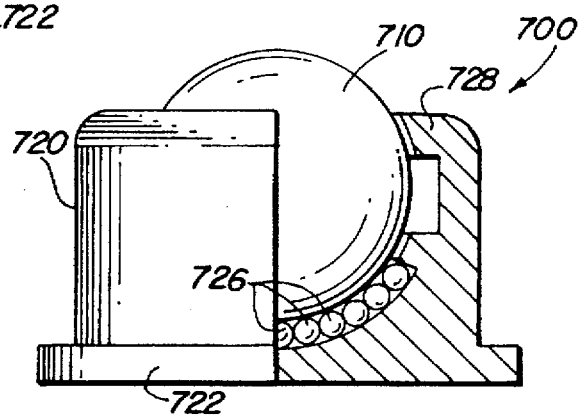
FIG. 33 is a partial cross-sectional view from the side of the roller assembly illustrated in FIG. 32, showing bearings contained in the combination race/cup.

Referring next to FIGS. 32 and 33, a roller assembly 700 is illustrated which uses an alternate manner of support for a spherical roller 710. The spherical roller 710 is pre-assembled into a combination race/cup 720. The base of the combination race/cup 720 has a circular flange 722 extending outwardly therefrom. The interior of the combination race/cup 720 has a hemispherical race 724 located therein, with a plurality of ball bearings 726 located therein to support the spherical roller 710. The combination race/cup 720 also includes an inwardly extending flange 728 located at the top thereof to retain the spherical roller 710 in the combination race/cup 720.

Figure 34:
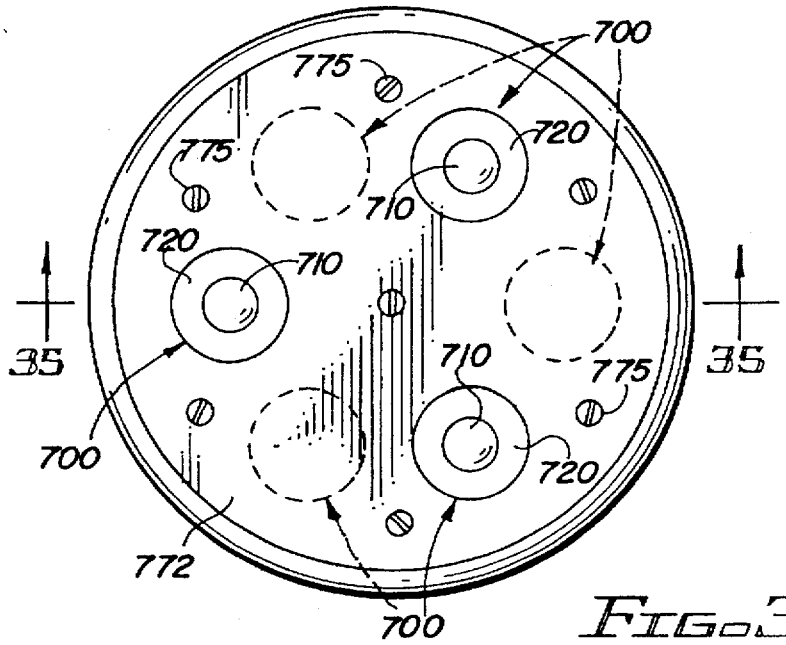
FIG. 34 is a plan view of another alternate embodiment roller hockey puck in which six of the roller assemblies illustrated in FIGS. 32 and 33 are used, showing the spherical rollers from three of the roller assemblies extending from the face of the puck body, and also showing with phantom lines the location of the other three roller assemblies from which spherical rollers extend from the opposite face of the puck body.
Figure 35:
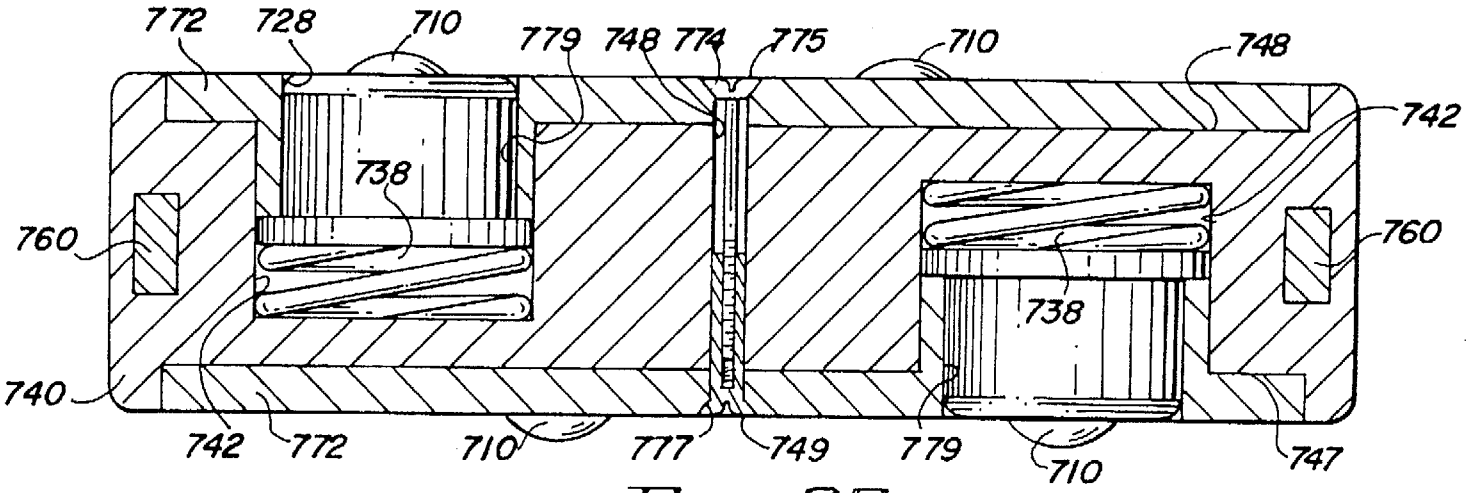
FIG. 35 is a cross-sectional view of the assembled roller hockey puck illustrated in FIG. 34, showing how the roller assemblies (not shown in cross-section) may be biased using coil springs (also not shown in cross-section)

Referring now to FIGS. 34 and 35, another alternate embodiment roller hockey puck is illustrated in which six of the roller assemblies 700 are used. This alternate embodiment roller hockey puck uses a puck body 740 in which six cylindrical cavities 742 are disposed therein and extend partially therethrough in an annular array as best shown in FIG. 34. Each of the six cylindrical cavities 742 is open onto one face of the puck body 740 and has a closed end located within the puck body 740.

Three of the six cylindrical cavities in the puck body 740 open to one face of the puck body 740, while the other three cylindrical cavities in the puck body 740 open to the opposing face of the puck body 740. The six cylindrical cavities 742 are arranged so that adjacent cylindrical cavities 742 alternate in their configuration. Two of the cylindrical cavities 742 in the puck body 740 are illustrated in FIG. 35. Located in the opposing faces of the puck body 740 around the annular array of the six cavities in the puck body 740 are large circular recesses 745 and 747.

Note that the puck body 740 has seven apertures 748 extending between each of the large circular recesses 745 and 747, only one of which is illustrated in FIG. 35. Also shown in FIG. 35 is an annular metal ring 760, which is molded into the puck body 740 midway between the opposing faces and near to the side edges of the puck body 740. Since no runners are used with the alternate embodiment roller hockey puck illustrated in FIGS. 34 and 35, no recesses for runners are required.

A coil spring 738 is inserted into each of the cylindrical cavities 742, with the coil springs 738 bearing against the closed ends of the cylindrical cavities 742. Note that for clarity, the coil springs 738 are shown in their entirety, and thus are not shown in cross-section. The six roller assemblies 700 are then placed into the cylindrical cavities 742 with the circular flange 722 first, such that the spherical rollers 100 and the tops of the combination race/cups 720 are biased out of the cylindrical cavities 742 by the coil springs 738. The circular flanges 722 of the combination race/cups 720 are sized to fit within the diameter of the cylindrical cavities 742. Note that for clarity, the roller assemblies 700 are also shown in their entirety, and thus are not shown in cross-section.

Two circular bearing support covers 772 may then be respectively installed into the large circular recesses 745 and 747. The circular bearing support covers 772 each have three circular openings 778 located therein at the locations of the cylindrical cavities 742 in the puck body 740. Extending inwardly from the circular bearing support covers 772 around each of the circular openings 778 are cylindrical segments 779. The cylindrical segments 779 fit within the cylindrical cavities 742, and act to retain the combination race/cups 720 in the puck body 740 since the circular flanges 722 of the combination race/cups 720 are larger than the inner diameter of the cylindrical segments 779.

The circular bearing support covers 772 each have seven countersunk apertures 774 which are located therein, only two of which are illustrated in FIG. 35. A flat-head bolt 775 is inserted into each of the apertures 774 in one of the circular bearing support covers 772, and then into the corresponding one of the apertures 748 in the puck body 740. A flat-head female bolt 777 is inserted into each of the apertures 774 in the other of the circular bearing support covers 772, and then into the corresponding one of the apertures 748 in the puck body 740. The flat-head bolts 775 are then screwed into the flat-head female bolts 777, thereby retaining the circular bearing support covers 772 on the puck body 740.

The circular bearing support covers 772 retain the coil springs 738 inside the wider cavities 742, where the coil springs 738 urge the roller assemblies 700 to the positions illustrated in FIG. 35, with the spherical rollers 710 extending just above the surfaces of the circular bearing support covers 772. The coil springs 738 act to absorb shock when the roller hockey puck illustrated in FIGS. 34 and 35 is airborne and falls to the paved surface.

Figure 36:
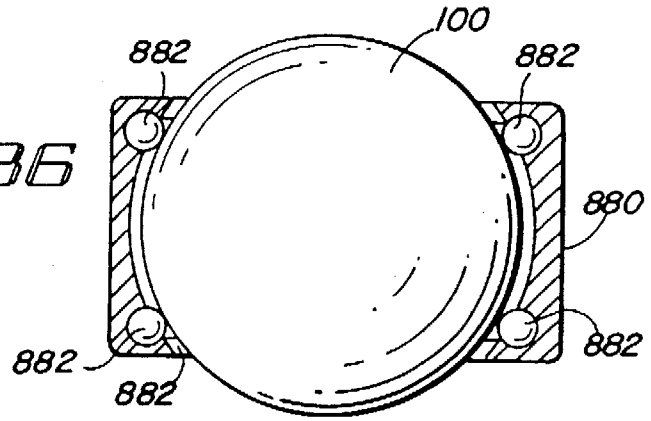
FIG. 36 is a cross-sectional view of an alternate embodiment bearing housing member which may be substituted for two of the annular bearings arrays illustrated in FIG. 8, which are used to rotatably support the spherical roller in the assembled roller hockey puck illustrated in FIGS. 13 and 14.

Referring finally to FIG. 36, an alternate embodiment bearing housing member 880 is illustrated. The bearing housing member 880 supports two spaced-apart annular races 884 therein, each of which is filled with ball bearings 882. The spherical roller 100 is rotatably supported within the two arrays of ball bearings 882. The bearing housing member 880 may be substituted for the two annular bearings arrays 80 (which are illustrated in FIG. 8) and used, for example, in the assembled roller hockey puck illustrated in FIGS. 13 and 14.

It may therefore be appreciated from the above detailed description of the preferred embodiment of the present invention that it teaches a roller hockey puck which will glide relatively freely over the irregularities inherent in a paved surface, thereby gliding in a manner similar to the way an ice hockey puck glides on ice. The roller hockey puck of the present invention does so because of its low coefficient of friction even when gliding over a paved surface, approaching the low coefficient of friction exhibited by an ice hockey puck when gliding over ice as closely as is possible. The roller hockey puck of the present invention is highly resistant to deterioration in this low coefficient of friction due to its construction, which uses ball bearings to support its spherical rollers.

The roller hockey puck of the present invention is also highly resistant to use-related wear, and its runners, which will exhibit the most wear, are quickly and easily replaceable. Due to its design, the roller hockey puck of the present invention behaves remarkably like an ice hockey puck behaves on ice when it is hit. In this regard, the roller hockey puck of the present invention exhibits a high degree of stability when hit, not flipping over and tumbling as easily as previously known roller hockey pucks. Depending on the choice of materials used to manufacture the roller hockey puck of the present invention, it may also be of a similar size and weight to an ice hockey puck.

The roller hockey puck of the present invention is of a construction which is both durable and long lasting, and which will require essentially no maintenance, other than replacing the worn runners as needed. The roller hockey puck of the present invention is also of inexpensive construction to enhance its market appeal and to thereby afford it the broadest possible market. Finally, all of the aforesaid advantages and objectives of the roller hockey puck of the present invention are achieved without incurring any substantial relative disadvantage.

Although an exemplary embodiment of the roller hockey puck of the present invention has been shown and described with reference to particular embodiments and applications thereof, it will be apparent to those having ordinary skill in the art that a number of changes, modifications, or alterations to the invention as described herein may be made, none of which depart from the spirit or scope of the present invention. All such changes, modifications, and alterations should therefore be seen as being within the scope of the present invention.

What is claimed is:

1. A roller hockey puck for use on paved surfaces, the roller hockey puck comprising:

a puck body having a generally cylindrical outer periphery and first and second opposing faces each having a generally circular configuration, said puck body having a first cavity disposed therein, said first cavity having a first opening located in said first opposing face and a second opening located in said second opposing face;

a first spherical roller disposed in said first cavity in said puck body;

a first array of bearings located within said puck body in a manner whereby said first array of bearings rotatably supports said first spherical roller in a manner whereby said first spherical roller is free to rotate in any direction; and first bearing support apparatus for maintaining said first array of bearings in a defined placement within said puck body to thereby rotatably support said first spherical roller in a position in which said first spherical roller partially extends above the exterior surface of said puck body.

2. A roller hockey puck as defined in claim 1, additionally comprising:

runner means, disposed on at least one of said first and second opposing faces, for providing a low friction gliding surface and stabilizing said roller hockey puck as it glides over a paved surface.

3. A roller hockey puck as defined in claim 2, wherein said runner means comprises:

a first annular circular runner for placement on said first opposing face of said puck body inside said cylindrical outer periphery of said puck body and around said first opening in said first opposing face of said puck body; and a second annular circular runner for placement on said second opposing face of said puck body inside said cylindrical outer periphery of said puck body and around said second opening in said second opposing face of said puck body.

4. A roller hockey puck as defined in claim 3, wherein said puck body comprises:

a first shallow annular recess disposed in said first opposing face of said puck body inside said cylindrical outer periphery of said puck body, said first annular circular runner fitting partially into first shallow annular recess; and a second shallow annular recess disposed in said second opposing face of said puck body inside said cylindrical outer periphery of said puck body, said second annular circular runner fitting partially into second shallow annular recess.

5. A roller hockey puck as defined in claim 4, wherein said first and second circular runners each have top and bottom surfaces which are flat.

6. A roller hockey puck as defined in claim 5, wherein said first and second shallow annular recesses each have a plurality of apertures located therein, and wherein said first and second circular runners each have a plurality of recessed areas located in said top surfaces thereof at spaced intervals around said first and second circular runners, an aperture being located in each of said recessed areas in said first and second circular runners, said apertures in said first and second circular runners being aligned with said apertures in said first and second shallow annular recesses, said roller hock puck additionally comprising:

a plurality of screws for placement through said apertures in said first and second circular runners and into said apertures in said first and second shallow annular recesses, said screws thereby securing said first and second circular runners respectively in said first and second shallow annular recesses.

7. A roller hockey puck as defined in claim 2, wherein said first opposing face of said puck body has a plurality of apertures located therein in an annular array disposed around said first opening in said first opposing face of said puck body, and wherein said second opposing face of said puck body has a plurality of apertures located therein in an annular array disposed around said second opening in said second opposing face of said puck body, and wherein said runner means comprises:

a plurality of puck rivets each having a rounded circular head which is supported by a serrated shaft, said plurality of puck rivets being mounted onto said puck body by inserting said serrated shafts of said puck rivets into said annular arrays of apertures in said first and second opposing faces of said puck body.

8. A roller hockey puck as defined in claim 7, wherein each aperture of said annular arrays of apertures in said first and second opposing faces of said puck body has a shallow circular recess disposed thereabout, said rounded circular heads of said plurality of puck rivets each fitting partially into one of said circular recesses.

9. A roller hockey puck as defined in claim 2, wherein said first opposing face of said puck body has a plurality of spaced-apart pairs of apertures located therein in an annular array disposed around said first opening in said first opposing face of said puck body, and wherein said second opposing face of said puck body has a plurality of spaced-apart pairs of apertures located therein in an annular array disposed around said second opening in said second opposing face of said puck body, and wherein said runner means comprises:

a plurality of puck rivets each having a rounded oval head which is supported by two spaced-apart serrated shafts, said plurality of puck rivets being mounted onto said puck body by inserting said spaced-apart serrated shafts of each of said puck rivets into one set of said spaced-apart pairs of apertures in said first and second opposing faces of said puck body.

10. A roller hockey puck as defined in claim 9, wherein each spaced-apart pair of apertures in said first and second opposing faces of said puck body has a shallow oval recess disposed thereabout, said rounded oval heads of said plurality of puck rivets each fitting partially into one of said oval recesses.

11. A roller hockey puck as defined in claim 2, wherein said runner means is made of a hard plastic material which is durable and has a very low coefficient of friction, which material is selected from the group consisting of polytetrafluoroethylene and nylon.

12. A roller hockey puck as defined in claim 1, wherein said first spherical roller has a diameter which is larger than the thickness of said puck body between said first and second opposing faces.

13. A roller hockey puck as defined in claim 1, wherein said first array of bearings comprises:

a first annular race member having a first plurality of ball bearings disposed therein, said first annular race member being disposed in said first cavity closer to said first opening than to said second opening; and a second annular race member having a second plurality of ball bearings disposed therein, said second annular race member being disposed in said first cavity closer to said second opening than to said first opening, said first spherical roller being supported entirely between first and second pluralities of ball bearings.

14. A roller hockey puck as defined in claim 13, wherein said first bearing support apparatus comprises:

a first bearing support cap for installation in said first opening in said first opposing face of said puck body, said first bearing support cap retaining said first annular race member in said first cavity in said puck body and said first plurality of ball bearings in contact with said first spherical roller; and a second bearing support cap for installation in said second opening in said second opposing face of said puck body, said second bearing support cap retaining said second annular race member in said first cavity in said puck body and said second plurality of ball bearings in contact with said first spherical roller.

15. A roller hockey puck as defined in claim 14, wherein said first and second bearing support caps are respectively mounted in positions relatively flush with said first and second opposing faces of said puck body, and wherein said first and second bearing support caps each have a circular opening therein through which opposing portions of said first spherical roller extend above the exterior surfaces of said first and second bearing support caps and said first and second opposing faces of said puck body.

16. A roller hockey puck as defined in claim 15, wherein said circular openings in said first and second bearing support caps each have an inwardly-projecting annular brush member mounted therein, said annular brush members having inwardly extending free ends extending close adjacent said first spherical roller.

17. A roller hockey puck as defined in claim 15, wherein said first and second bearing support caps are respectively mounted in positions relatively flush with said first and second opposing faces of said puck body using a plurality of screws extending through apertures located in said first and second bearing support caps and into apertures located in said puck body.

18. A roller hockey puck as defined in claim 15, wherein said first bearing support cap comprises:

a first cylindrical segment for placement into said first cavity, said first cylindrical segment being threaded on the inside thereof; and wherein said second bearing support cap comprises:

a second cylindrical segment for placement into said first cavity, said second cylindrical segment being threaded on the outside thereof, said second cylindrical segment of said second bearing support cap being screwed into said first cylindrical segment of said first bearing support cap to retain said first and second bearing support caps in positions relatively flush with said first and second opposing faces of said puck body.

19. A roller hockey puck as defined in claim 14, additionally comprising:

a first annular resilient washer for placement between said first annular race member and said first bearing support cap; and a second annular resilient washer for placement between said second annular race member and said second bearing support cap.

20. A roller hockey puck as defined in claim 14, wherein said first annular race member and said first bearing support cap are manufactured in unitary fashion as a single component, and wherein said second annular race member and said second bearing support cap are also manufactured in unitary fashion as a single component.

21. A roller hockey puck as defined in claim 1, additionally comprising:

an annular metal ring located within said puck body midway between said first and second opposing faces of said puck body and near said cylindrical outer periphery of said puck body, said annular metal ring being made of a relatively heavy metal material.

22. A roller hockey puck as defined in claim 1, wherein said puck body has second and third cavities disposed therein, said second and third cavities each having a first opening located in said first opposing face and a second opening located in said second opposing face, said roller hockey puck additionally comprising:

a second spherical roller disposed in said second cavity in said puck body;

a third spherical roller disposed in said third cavity in said puck body;

a second array of bearings located within said puck body in a manner whereby said second array of bearings rotatably supports said second spherical roller in a manner whereby said second spherical roller is free to rotate in any direction;

a third array of bearings located within said puck body in a manner whereby said third array of bearings rotatably supports said third spherical roller in a manner whereby said third spherical roller is free to rotate in any direction;

second bearing support apparatus for maintaining said second array of bearings in a defined placement within said puck body to thereby rotatably support said second spherical roller in a position in which said second spherical roller partially extends above the exterior surface of said puck body; and third bearing support apparatus for maintaining said third array of bearings in a defined placement within said puck body to thereby rotatably support said third spherical roller in a position in which said third spherical roller partially extends above the exterior surface of said puck body.

23. A roller hockey puck as defined in claim 1, wherein said first cavity at said second opposing face is closed off by said puck body such that said first cavity has said first opening located in said first opposing face, but said second opening located in said second opposing face is closed off by said puck body, wherein said first bearing support apparatus comprises:

a first combination race/cup having said first array of bearings located therein, said first combination race/cup retaining said first spherical roller therein with a portion of said first spherical roller extending therefrom, said first combination race/cup, said first array of bearings, and said first spherical roller together comprising a first roller assembly which is disposed in said first cavity in said puck body;

first means for biasing said first roller assembly in said first cavity in said puck body in a direction tending to urge a portion of said first spherical roller above said first opposing face of said puck body; and first means for limiting how far a portion of said first spherical roller can extend above said first opposing face of said puck body; said roller hockey puck additionally comprising:

second, third, fourth, fifth, and sixth cavities each disposed in said puck body together with said first cavity in a consecutive annular array, each of said third and fifth cavities having a first opening located in said first opposing face, and each of said second, fourth, and sixth cavities having a first opening located in said second opposing face;

second, third, fourth, fifth, and sixth roller assemblies respectively disposed in said second, third, fourth, fifth, and sixth cavities in said puck body;

second, third, fourth, fifth, and sixth means for respectively biasing said second, third, fourth, fifth, and sixth roller assemblies in said second, third, fourth, fifth, and sixth cavities in said puck body, respectively, said third and fifth roller assemblies being biased in a direction tending to urge a portion of third and fifth spherical rollers respectively contained therein above said first opposing face of said puck body, said second, fourth, and sixth roller assemblies being biased in a direction tending to urge a portion of second, fourth, and sixth spherical rollers respectively contained therein above said second opposing face of said puck body; and first, third, and fifth means for limiting how far a portion of said first, third, and fifth spherical rollers, respectively, can extend above said first opposing face of said puck body, and second, fourth, and sixth means for limiting how far a portion of said second, fourth, and sixth spherical rollers, respectively, can extend above said second opposing face of said puck body.

24. A roller hockey puck as defined in claim 1, wherein said puck body is made of a material from the group consisting of plastic material such as polyurethane and rubber.

25. A roller hockey puck as defined in claim 1, wherein said puck body is approximately the same size as a regulation ice hockey puck.

26. A roller hockey puck as defined in claim 1, wherein said first spherical roller is made of a tough, durable material from the group consisting of nylon, delrin, polypropylene, polyurethane, and high density hard rubber material.

27. A roller hockey puck for use on paved surfaces, the roller hockey puck comprising:

a puck body having a generally cylindrical outer periphery and first and second opposing faces each having a generally circular configuration, said puck body having a first cavity disposed therein, said first cavity having a first opening located in said first opposing face and a second opening located in said second opposing face;

a first spherical roller disposed in said first cavity in said puck body;

an array of bearings located within said puck body in a manner whereby said array of bearings rotatably supports said first spherical roller in a manner whereby said first spherical roller is free to rotate in any direction;

bearing support apparatus for maintaining said array of bearings in a defined placement within said puck body to thereby rotatably support said first spherical roller in a position in which said first spherical roller partially extends above both of said first and second opposing faces of said puck body; and runners disposed in annular fashion on each of said first and second opposing faces to provide a low friction gliding surface and stabilize said roller hockey puck as it glides over a paved surface.

28. A roller hockey puck for use on paved surfaces, the roller hockey puck comprising:

a puck body having a generally cylindrical outer periphery and opposing faces each having a generally circular configuration, said puck body having a cavity disposed therein, said cavity extending between said opposing faces;

a spherical roller disposed in said cavity in said puck body, said spherical roller partially extending above said opposing faces of said puck body;

an array of bearings located within said puck body in a manner whereby said array of bearings rotatably supports said spherical roller; and bearing support apparatus for maintaining said array of bearings in a defined placement within said puck body.

29. A method of making a roller hockey puck for use on paved surfaces, the method comprising:

disposing a cavity in a puck body, said puck body having a generally cylindrical outer periphery and first and second opposing faces each having a generally circular configuration, said cavity having a first opening located in said first opposing face and a second opening located in said second opposing face;

placing a spherical roller in said cavity in said puck body;

rotatably supporting said spherical roller with an array of bearings located within said puck body, said spherical roller being supported by said array of bearings in a manner whereby said spherical roller is free to rotate in any direction; and maintaining said array of bearings in a defined placement within said puck body bearing with bearing support apparatus to thereby rotatably support said spherical roller in a position in which said spherical roller partially extends above the exterior surface of said first and second opposing faces of said puck body.

30. A method as defined in claim 29, additionally comprising:

disposing runner means on said first and second opposing faces of said puck body, said runner means providing a low friction gliding surface and stabilizing said roller hockey puck as it glides over a paved surface.

* * * * *